US011820029B2

(12) United States Patent
Thomet et al.

(10) Patent No.: US 11,820,029 B2
(45) Date of Patent: Nov. 21, 2023

(54) CONVERTIBLE CUTTING DEVICE

(71) Applicant: Kuhn Rikon AG, Rikon im Tösstal (CH)

(72) Inventors: Stefan Thomet, Zurich Oerlikon (CH); Marco Waltenspul, Rikon (CH); Jochen Schaepers, Munchenstein (CH)

(73) Assignee: Kuhn Rikon AG, Rikon im Tösstal (CH)

( * ) Notice: Subject to any disclaimer, the term of this patent is extended or adjusted under 35 U.S.C. 154(b) by 151 days.

(21) Appl. No.: 17/454,911

(22) Filed: Nov. 15, 2021

(65) Prior Publication Data

US 2023/0150154 A1 May 18, 2023

(51) Int. Cl.
*B26B 11/00* (2006.01)
*B26B 13/28* (2006.01)

(52) U.S. Cl.
CPC ..... *B26B 11/005* (2013.01); *B26B 13/28* (2013.01)

(58) Field of Classification Search
CPC ..... B26B 11/00; B26B 11/005; B26B 11/006; B26B 13/00; B26B 13/28
See application file for complete search history.

(56) References Cited

U.S. PATENT DOCUMENTS 667,914 A * 2/1901 Klever, Jr. ..... B25B 7/22 30/271
1,771,031 A 7/1930 Court
2,249,378 A * 7/1941 Di Leo ..... B26B 13/22 30/DIG. 8
3,835,533 A 9/1974 Granson
4,037,276 A * 7/1977 Brinker ..... B26B 13/00 D8/57
4,528,707 A 7/1985 Aida
5,226,237 A * 7/1993 Rancour ..... B26B 17/00 30/191
5,255,438 A 10/1993 Morgan
5,377,412 A * 1/1995 Schofield ..... B26B 13/28 30/262
5,430,940 A 7/1995 Lym
5,499,454 A 3/1996 Compton
5,501,016 A * 3/1996 Kuribayashi ..... B26B 13/20 30/260

(Continued)

FOREIGN PATENT DOCUMENTS

CN 106313136 A 1/2017
CN 106493755 A 3/2017

(Continued)

*Primary Examiner* — Sean M Michalski
*Assistant Examiner* — Richard D Crosby, Jr.
(74) *Attorney, Agent, or Firm* — Sughrue Mion, PLLC

(57) ABSTRACT

A convertible cutting device (1, 1') comprises a first handle (2, 2') with a first blade (8, 8') and a second handle (5, 5') with a second blade (11, 11'), and a conversion device (14, 14') being configured to adapt at least a scissor position and a knife position. The conversion device (14, 14') and the second handle (5, 5') comprise in each case at least one abutment section (15, 15'; 18, 18') being configured to abut against one another when the conversion device (14, 14') is in the knife position and when the first handle (2, 2') and the second handle (5, 5') are in the closed position, whereby the conversion device (14, 14') is retained in the knife position.

19 Claims, 13 Drawing Sheets

(56) References Cited

U.S. PATENT DOCUMENTS

| | | | | |
|---|---|---|---|---|
| 5,749,147 | A | 5/1998 | Hasegawa | |
| 6,301,787 | B2 * | 10/2001 | Mock | B26B 13/16 30/252 |
| 6,725,544 | B1 | 4/2004 | Wu | |
| 7,204,022 | B2 * | 4/2007 | Tsuda | B26B 13/005 7/128 |
| 9,346,178 | B2 * | 5/2016 | Tsai | B25B 7/14 |
| 11,027,399 | B2 * | 6/2021 | Hoppe | B25B 7/22 |
| 2003/0101590 | A1 | 6/2003 | Ronan et al. | |
| 2003/0221320 | A1 | 12/2003 | Carpenter et al. | |
| 2004/0231163 | A1 | 11/2004 | Sakai | |
| 2006/0010692 | A1 | 1/2006 | Kuan Huo | |
| 2007/0101583 | A1 | 5/2007 | Tsai | |
| 2007/0209213 | A1 | 9/2007 | Chorpash | |
| 2007/0240316 | A1 | 10/2007 | Yu et al. | |
| 2008/0022535 | A1 | 1/2008 | Underhill | |
| 2008/0295339 | A1 | 12/2008 | Lipscomb et al. | |
| 2009/0000127 | A1 | 1/2009 | Smith | |
| 2009/0151170 | A1 | 6/2009 | Lee et al. | |
| 2009/0277019 | A1 * | 11/2009 | Mueller | B26B 13/16 30/345 |
| 2010/0107421 | A1 | 5/2010 | Cedar et al. | |
| 2012/0137526 | A1 | 6/2012 | Forman et al. | |
| 2014/0033542 | A1 | 2/2014 | Covel et al. | |
| 2014/0101944 | A1 | 4/2014 | Moultrie | |
| 2014/0190015 | A1 | 7/2014 | Forman | |
| 2014/0251099 | A1 | 9/2014 | Covarrubias-Garcia et al. | |
| 2017/0190059 | A1 | 7/2017 | Martinez | |
| 2019/0210206 | A1 | 7/2019 | Nix | |

FOREIGN PATENT DOCUMENTS

| | | | |
|---|---|---|---|
| CN | 106493756 | A | 3/2017 |
| CN | 107139224 | A | 9/2017 |
| CN | 108015813 | A | 5/2018 |
| CN | 209403095 | U | 9/2019 |
| CN | 210148141 | U | 3/2020 |
| JP | 3067812 | U | 4/2000 |
| KR | 10-2013-0119635 | A | 11/2013 |
| KR | 10-2017-0056311 | A | 5/2017 |
| TW | M552420 | U | 12/2017 |
| WO | 95/03157 | A1 | 2/1995 |
| WO | 96/30174 | A1 | 10/1996 |
| WO | 2008/048063 | A1 | 4/2008 |

* cited by examiner

CONVERTIBLE CUTTING DEVICE

TECHNICAL FIELD

The present invention relates to a convertible cutting device according to claim 1 and to a method of producing a convertible cutting device according to claim 16.

PRIOR ART

Cutting devices for performing a cutting operation such as a pair of scissors and cutting devices for performing a knife operation such as a knife are typically provided as two separate devices. Since these different cutting devices are useful for distinct operations a cutting device comprising a combination of these different cutting devices is desirable as a user obtains greater utility from a single tool.

Combined cutting devices are known from the prior art. For instance, from WO 95/03157 a scissors combined with a cutter knife is known, wherein a cutter knife is arranged in a knife case on a blade of the scissors. By pushing a slide knob of the cutter knife forwards and backwards, a blade of the cutter knife comes into or out of the knife case. US 2010/0107421 A1 discloses a convertible cutting instrument having a pair of handles and that can be operated as a pair of scissors in a dual-blade configuration and as a knife in a single-blade configuration upon operation of a conversion mechanism. The conversion mechanism converts an inwardly facing cutting edge into an outwardly facing cutting edge, so that the cutting instrument can be used as a knife. In some embodiments, the instrument furthermore comprises a lock mechanism or a safety mechanism. The lock mechanism maintains the cutting instrument in the dual-blade configuration for instance by requiring a user to continuously press a conversion button. The safety mechanism prevents the instrument from entering the single-blade configuration such as a detent and a leaf spring component forming a safety mechanism that biases the blades into the closed position.

Several drawbacks are associated with the devices known from the state of the art. For instance, the known devices have a deep level of security or a complicated design comprising a multitude of elements, which make the production complex and expensive. Also, the known devices can be cumbersome to use, for example since several elements have to be operated, which often requires two-handed use.

SUMMARY OF THE INVENTION

It is an object of the present invention to overcome the drawbacks of the state of the art. In particular, it is an object to provide a convertible cutting device being simplified in terms of design and handling.

In particular, a convertible cutting device is provided, wherein the cutting device comprises a first handle comprising a proximal region and a distal region and a second handle comprising a proximal region and a distal region. A first blade is arranged in the distal region of the first handle and comprises a first cutting edge and a first outer edge being arranged opposite to the first cutting edge. A second blade is arranged in the distal region of the second handle and comprises a second cutting edge and a second outer edge being arranged opposite to the second cutting edge. The first handle and the second handle are pivotably coupled to one another and are pivotable between at least an opened position and a closed position. To this end it is preferred that the first and second handles are pivotable from the opened position into the closed position by pressing the first handle and the second handle towards one another. Since the first blade is arranged on the first handle and the second blade is arranged on the second handle, the first and second blades are pivotably coupled to one another as well. The cutting device furthermore comprises a conversion device. The conversion device is configured to adapt at least a scissor position and a knife position. When the conversion device is in the scissor position, the conversion device prevents the first cutting edge from extending beyond the second outer edge and furthermore prevents the second cutting edge from extending beyond the first outer edge. When the conversion device is in the knife position, the first cutting edge extends at least partially beyond the second outer edge and/or the second cutting edge extends at least partially beyond the first outer edge. The conversion device and the second handle comprise in each case at least one abutment section and wherein the abutment section of the conversion device and the abutment section of the second handle are configured to abut against one another when the conversion device is in the knife position and when the first handle and the second handle are in the closed position, whereby the conversion device is retained in the knife position.

When the first and second handles are in the opened position, the first blade is spaced apart from the second blade with the first and second cutting edges facing one another. When the first and second handles are in the closed position and the conversion device is in the scissor position, the first and second blades substantially overlap one another. In this configuration, the first cutting edge does not extend beyond the second outer edge.

However, when the conversion device is transferred into the knife position, the first cutting edge extends at least partially beyond the second outer edge to form a first outwardly facing cutting edge and/or the second cutting edge extends at least partially beyond the first outer edge to form a second outwardly facing cutting edge.

When the first cutting edge extends at least partially beyond the second outer edge the first cutting edge is arranged to perform a knife operation. The first cutting edge extending at least partially beyond the second outer edge is understood such, that the first cutting edge protrudes at least partially over the second outer edge so as to face outwardly. Starting from a distal end of the convertible cutting device towards a proximal end of the convertible cutting device the extension or protrusion of the first cutting edge preferably decreases. In other words, the amount of the extension or protrusion of the first cutting edge at the distal end of the convertible cutting device is preferably greatest. Likewise, when the second cutting edge extends at least partially beyond the first outer edge the second cutting edge is arranged to perform a knife operation. The second cutting edge extending at least partially beyond the first outer edge is understood such, that the second cutting edge protrudes at least partially over the first outer edge so as to face outwardly. Also in this case it is preferred that the extension or protrusion of the second cutting edge is greatest at the distal end of the convertible cutting device. Moreover, the convertible cutting device can be configured such, that only the first cutting edge extends at least partially beyond the second outer edge, or that only the second cutting edge extends at least partially beyond the first cutting edge, or that both the first cutting edge extends at least partially beyond the second outer edge as well as the second cutting edge extends at least partially beyond the first cutting edge when the conversion device is in the knife position. In the former two cases, the convertible cutting device adapts a single-blade configuration. In the latter case, the convertible cutting device adapts a double-blade configuration.

When performing a knife operation a user may use the first cutting edge or the second cutting edge to chop, slit, or stab objects, for instance.

As mentioned earlier, the conversion device and the second handle comprise in each case at least one abutment section. When the first handle and the second handle are in the closed position and when the conversion device is in the knife position, the abutment section of the conversion device abuts against the abutment section of the second handle. Said abutment prevents a transfer of the conversion device from the knife position into the scissor position. In other words, the conversion device is retained in the knife position. Hence, the convertible cutting device according to the invention is configured to retain the conversion device in the knife position by the conversion device and the first handle and/or the second handle. In other words, an additional device or a mechanism requiring a separate operation by a user can be dispensed with. Consequently, the convertible cutting device according to the invention is simple in terms of design and handling.

The abutment section of the conversion device preferably is an integral constituent of the conversion device. In other words, the abutment section of the conversion device is preferably formed on the conversion device. Again in other words, the abutment section of the conversion device and the conversion device preferably are a single-piece element. Additionally or alternatively, the abutment section of the second handle preferably is an integral constituent of the second handle. In other words, the abutment section of the second handle is preferably formed on the second handle. Again in other words, the abutment section of the second handle and the second handle preferably are a single-piece element.

It is particularly preferred that the abutment section of the conversion device comprises or consists of an abutment surface and/or that the abutment section of the second handle comprises or consists of an abutment surface. The abutment surface of the conversion device is particularly preferably configured to abut against the abutment surface of the first handle and/or the abutment surface of the conversion device is particularly preferably configured to abut against the abutment surface of the second handle in order to retain the conversion device in the knife position.

The first handle and the second handle when being in the closed position preferably define a retaining space. The conversion device is preferably at least partially and more preferably entirely arranged within said retaining space when the conversion device is in the knife position. It is preferred that the retaining space is at least partially delimited by the abutment section of the second handle. It is particularly preferred that the retaining space is at least partially delimited by the abutment surface of the second handle. The retaining space being defined by the first and second handles can thus be said to retain the conversion device in the knife position.

The retaining space is preferably formed between the first handle and the second handle when the handles are in the closed position. Furthermore, the conversion device preferably remains in the knife position as long as the first handle and the second handle are pressed towards one another.

The conversion device is preferably arranged in the proximal region of the first handle and/or in the proximal region of the second handle. In other words, the conversion device is preferably arranged in a proximal region of the convertible cutting device. It is furthermore preferred that the conversion device is at least partially arranged at a proximal end of the first handle and/or at a proximal end of the second handle when the conversion device is in the scissor position. Consequently, it is also preferred that the conversion device is at least partially arranged at the proximal end of the convertible cutting device when the conversion device is in the scissor position.

The conversion device preferably comprises at least one actuation element, and wherein the conversion device is transferable from the scissor position into the knife position upon an actuation of the actuation element.

The actuation element preferably at least partially protrudes from a proximal end of the first handle and/or from a proximal end of the second handle when the conversion device is in the scissor position. For instance, the actuation element can be provided in the form of knob or button that can be pushed along a pushing direction extending from the proximal end of the convertible cutting device towards the distal end of the convertible cutting device, whereby the conversion device is pushed along the pushing direction as well. Additionally or alternatively, the actuation element preferably laterally protrudes from the first handle and/or from the second handle. For instance, the actuation element can be provided in the form of a laterally protruding gripping element such as a corrugated surface that can be gripped by a user in order to push the actuation element and thus the conversion device along the pushing direction. The actuation element and the conversion device preferably are a single-piece element, i.e. it is preferred that the actuation element is formed on the conversion device.

The conversion device is preferably movably mounted on the first handle and is configured to move along the first handle when being transferred from the scissor position into the knife position and/or when being transferred from the knife position into the scissor position. The movement of the conversion device from the scissor position into the knife position is particularly preferably caused by an actuation of the actuation element.

It is furthermore preferred that the conversion device performs a linear movement and/or a movement extending along an axis being parallel to a longitudinal axis of the first handle.

The longitudinal axis of the first handle preferably extends from the proximal end of the first handle towards the distal end of the first handle. Again in other words, the conversion device when being transferred from the scissor position into the knife position is preferably moved along and/or with respect to the first handle. Moreover, the pushing direction along which the actuation element is pushed as mentioned above preferably extends parallel to the longitudinal axis as well.

The first handle and the conversion device in each case preferably comprise at least one guiding element, and wherein the guiding elements are configured to guide a movement of the conversion device. The guiding element of the first handle preferably is a guiding pin or dovetail track that is engaged within the guiding element of the conversion device in the form of a guiding slot or dovetail guide or vice versa. Hence, it is preferred that the conversion device is movable in a guided manner from the scissor position into the knife position and/or from the knife position into the scissor position by the guiding elements.

The conversion device is preferably transferable, in particular movable, from the scissor position into the knife position when the first handle and the second handle are in the opened position. It is furthermore preferred that the conversion device is transferable from the knife position into the scissor position in the absence of a pressing of the first handle and the second handle against one another.

The first handle preferably comprises a recess and wherein the conversion device is movable along and/or at least partially within said recess. Additionally or alternatively, the second handle preferably comprises at least one recess, and wherein the conversion device is movable along and/or at least partially within said recess. The recess of the first handle is preferably arranged on an inner side of the first handle. Likewise, the recess of the second handle is preferably arranged on an inner side of the second handle. Hence, the recesses of the first and second handles preferably face one another. It is furthermore preferred that the recesses of the first and second handles at least partially form the retaining space within which the conversion device can be at least partially arranged when the conversion device is in the knife position. Moreover, it is preferred that the abutment section of the second handle at least partially delimits the recess of the second handle.

The convertible cutting device preferably further comprises at least one biasing element that biases the conversion device into the scissor position. The biasing element is preferably arranged on the first handle and particularly preferably in the recess of the first handle. It is furthermore preferred that the biasing element is a spring. The conversion device is preferably transferable from the scissor position into the knife position by subjecting the conversion device to a conversion force that overcomes a biasing force exerted by the biasing element. It is furthermore preferred that the conversion device is transferred from the knife position into the scissor position by the biasing force in the event that the conversion force being exerted to the conversion device is stopped.

The second handle preferably comprises a limiting element being configured to limit a pivoting of the first handle with respect to the second handle. Additionally or alternatively the conversion device preferably comprises a limiting element being configured to limit a pivoting of the first handle with respect to the second handle.

The limiting element of the second handle and/or the limiting element of the conversion device preferably define a minimal spacing between the first handle and the second handle when the first handle and the second handle are in the closed position and when the conversion device is in the scissor position. The limiting element of the conversion device and the conversion device preferably are a single-piece element. Additionally or alternatively it is preferred that the limiting element of the second handle and the second handle preferably are a single-piece element. In other words, it is preferred that the limiting element of the conversion device is formed on the conversion device and/or that the limiting element of the second handle is formed on the second handle. When the conversion device is in the scissor position, the limiting element(s) ensures that the first and second blades are arranged to perform a scissor operation when the first and second handles pivot between the opened and closed position. When the two blades perform a scissor operation, the two blades pivot towards each other, such that an object being placed between the blades, e.g. a piece of cloth or paper, is cut by the cutting edges of the blades. The conversion device is preferably configured such, that the first blade and the second blade are pivoted towards one another while the conversion device is transferred from the scissor position into the knife position and/or such, that the first blade and the second blade are pivoted away from one another while the conversion device is transferred from the knife position into the scissor position. Thus, it is preferred that the transfer of the conversion device from the scissor position into the knife position removes the limitation imposed by the limiting element(s), whereby the first blade and the second blade can be pivoted past one another. Again in other words, the minimal spacing being upheld by the limiting element(s) is preferably removable upon the transfer of the conversion device from the scissor position into the knife position.

The limiting element of the second handle preferably is a protruding element that protrudes inwards towards the first handle. The limiting element of the second handle preferably furthermore terminates in a free end defining an abutment surface, herein called limiting surface. The limiting element of the conversion device preferably likewise defines an abutment surface, herein called limiting surface as well, and wherein the minimal spacing mentioned above is preferably achieved by an abutment between the limiting elements, in particular of their limiting surfaces. To this end it is conceivable that the limiting element of the conversion device is a protruding element that protrudes inwards towards the second handle as well.

It is furthermore preferred that the abutment surface of the second handle is formed on the limiting element of the second handle. Additionally or alternatively it is preferred that the abutment surface of the conversion device is formed on the limiting element of the conversion device.

The convertible cutting device preferably further comprises at least one locking device, wherein the locking device is configured to lock the first handle and the second handle in the closed position. It is furthermore preferred that the locking device is configured such that a locking of the first handle and the second handle is prevented when the conversion device is in the knife position. Instead, it is preferred that a locking of the first and second handles is enabled in the event that the conversion device is in the scissor position. Moreover, the locking device is preferably configured such, that a locking of the first handle and the second handle in the closed position is released upon pressing the first handle and the second handle against one another.

The locking device is preferably spring-loaded. Additionally or alternatively, the locking device preferably comprises at least a first engagement element and a second engagement element that are configured to engage one another, whereby the locking device is in a locking position where it locks the first handle and the second handle in the closed position. To this end it is preferred that the first engagement element is provided on the first handle and the second engagement element is provided on the second handle. For instance, the first engagement element can be a lug that is engageable by the second engagement element in the form of a hook or vice versa. Moreover, it is preferred that the first engagement element at least partially protrudes into the retaining space and/or that the second engagement element is pivotably mounted to the second handle. The second engagement element is particularly preferably mounted in a spring-loaded manner for instance by a lock spring.

It is furthermore preferred that a length of the second engagement element is larger than a diameter of the retaining space. These dimensions ensure that a locking of the first handle and the second handle is prevented when the conversion device is in the knife position since the second engagement element abuts against the first handle and thereby prevents the engagement with the first engagement element.

It is furthermore preferred that the conversion device comprises at least one pushing element and that the second handle comprises at least one pushable element, and wherein the pushing element is configured to push against the pushable element in the absence of a pressing force being exerted onto the first handle and the second handle, whereby the second handle is pivotable away from the first handle. In the event that the conversion device is in the knife position and the handles are in the closed position, the abutment being established between the abutment section of the second handle and the abutment section of the conversion device is thereby removed and the conversion device is transferred into the scissor position. A pushing of the pushing element is preferably caused by the biasing force of the biasing element that biases the conversion device into the scissor position.

The pushing element and the conversion device preferably are a single-piece element, i.e. it is preferred that the pushing element is formed on the conversion device. Additionally or alternatively, it is preferred that the pushable element and the second handle are a single-piece element, i.e. that the pushable element is formed on the second handle.

In a further aspect a method of producing a convertible cutting device preferably as described above, is provided. The method comprises the steps of i) providing a first handle comprising a proximal region and a distal region, ii) providing a second handle comprising a proximal region and a distal region, iii) arranging a first blade comprising a first cutting edge and a first outer edge being arranged opposite to the first cutting edge in the distal region of the first handle, iv) arranging a second blade comprising a second cutting edge and a second outer edge being arranged opposite to the second cutting edge in the distal region of the second handle, and v) providing a conversion device. The first handle and the second handle are pivotably coupled to one another and are pivotable between at least an opened position and a closed position. The conversion device is configured to adapt at least a scissor position and a knife position. When the conversion device is in the scissor position, the conversion device prevents the first cutting edge from extending beyond the second outer edge and furthermore prevents the second cutting edge from extending beyond the first outer edge. When the conversion device is in the knife position, the first cutting edge extends at least partially beyond the second outer edge and/or the second cutting edge extends at least partially beyond the first outer edge. The conversion device and the second handle comprise in each case at least one abutment section, and wherein the abutment section of the conversion device and the abutment section of the second handle are configured to abut against one another when the conversion device is in the knife position and when the first handle and the second handle are in the closed position, whereby the conversion device is retained in the knife position.

Any explanations made herein with regard to the convertible cutting device preferably likewise apply to the method of producing the convertible cutting device and vice versa.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Aspects of the convertible cutting device according to the invention will be discussed in greater with respect to the figures.

To this end, FIGS. 1 to 8*b* depict a convertible cutting device 1 according to a first embodiment and FIGS. 9 to 15*b* depict a convertible cutting device 1' according to a second embodiment. In fact, the convertible cutting device 1 according to the first embodiment corresponds to a convertible kitchen shear, whereas the convertible cutting device 1' according to the second embodiment corresponds to a convertible household shear.

Figure 1:
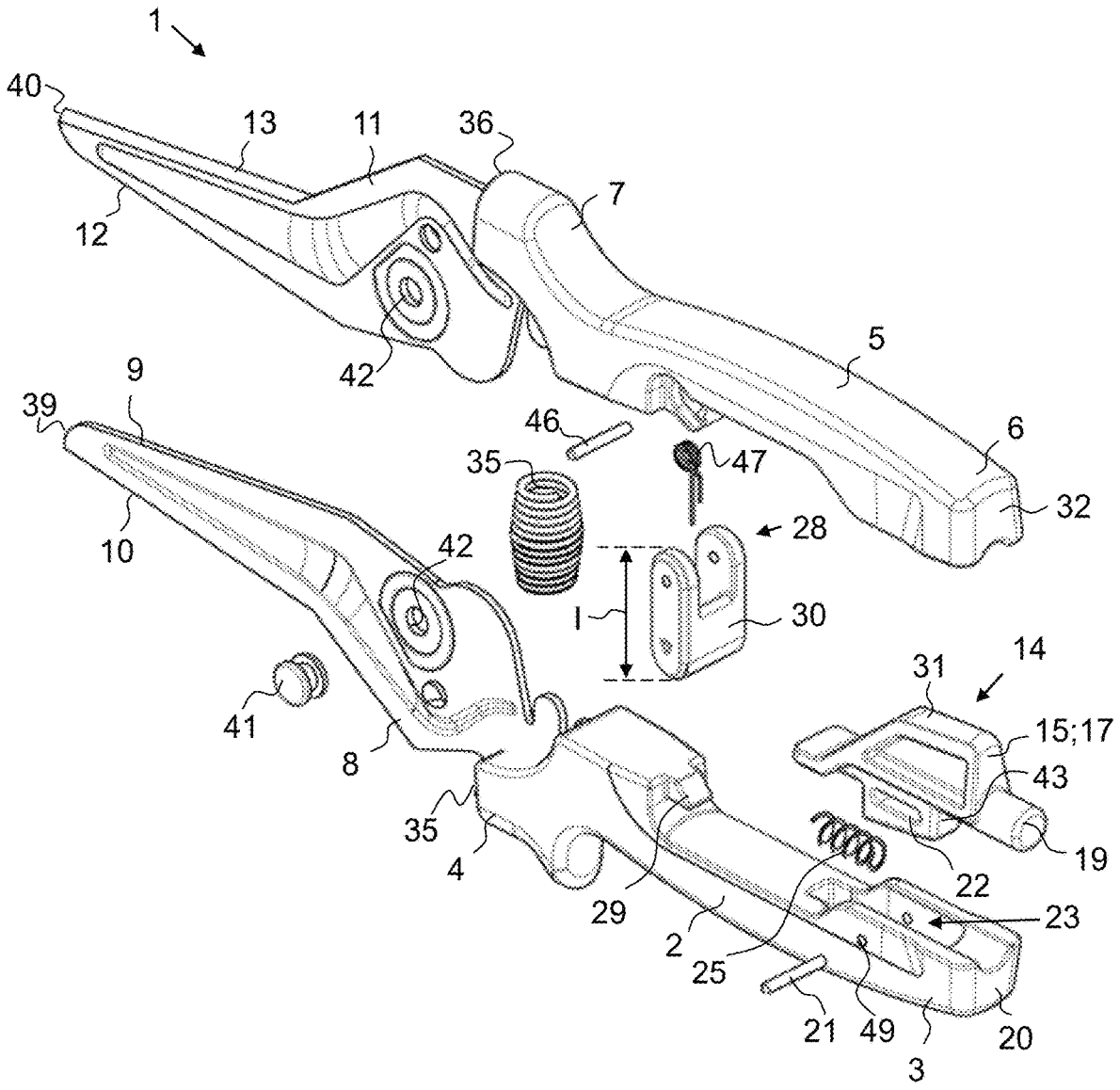
FIG. 1 shows an exploded view of a convertible cutting device comprising handles and a conversion device according to a first embodiment.
Figure 2:
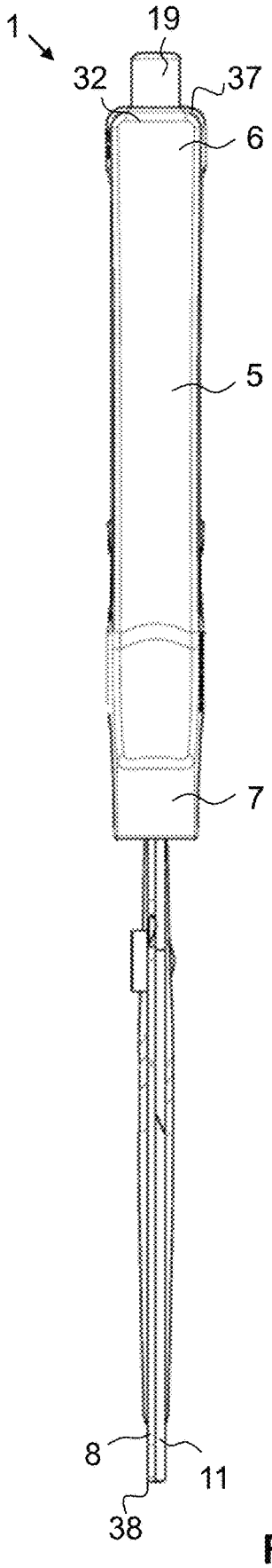
FIG. 2 shows a top view of the convertible cutting device according to FIG. 1.
Figure 3:
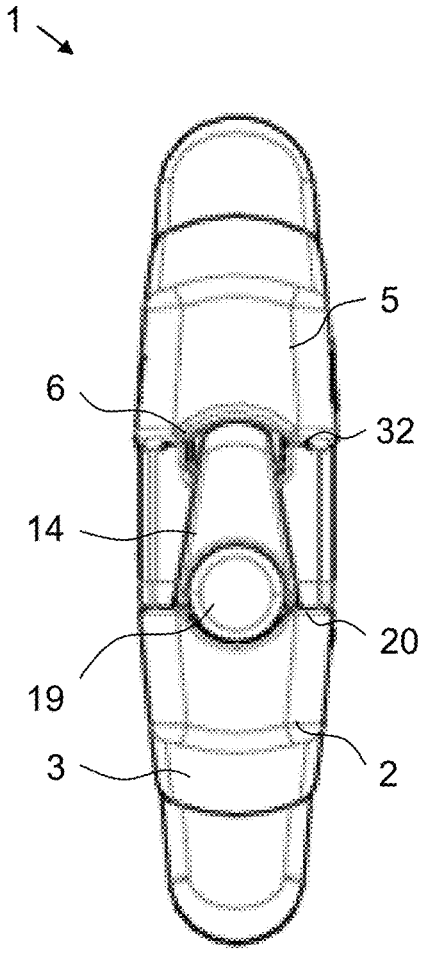
FIG. 3 shows a rear view of the convertible cutting device according to FIG. 1.
Figure 8A:
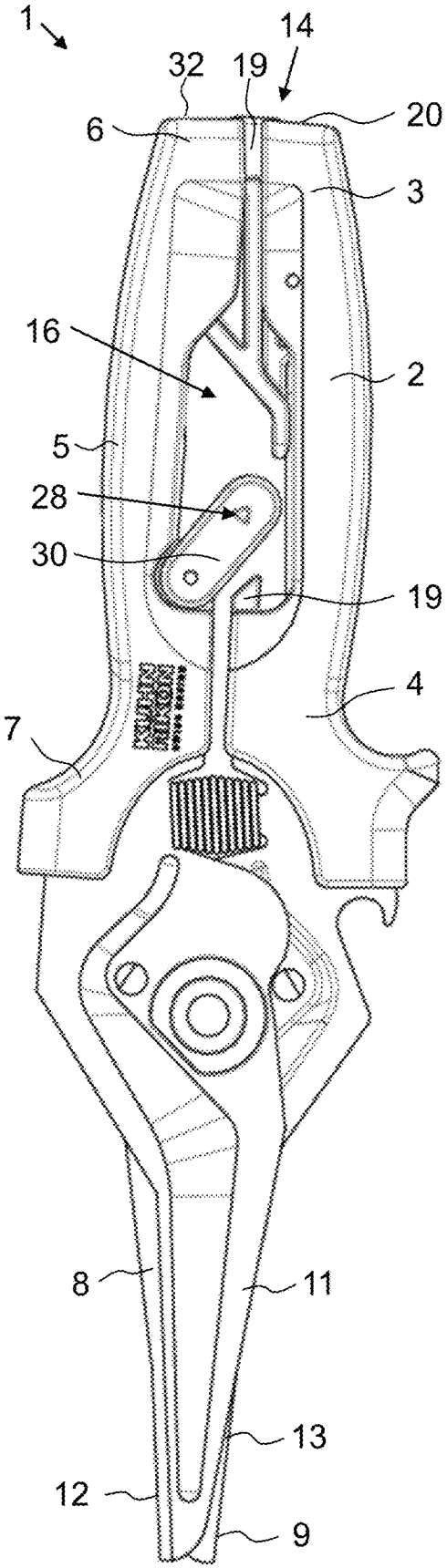
FIG. 8*a* shows a side view of the convertible cutting device according to FIG. 1, wherein the handles are in the closed position and the conversion device is in the knife position.
Figure 8B:
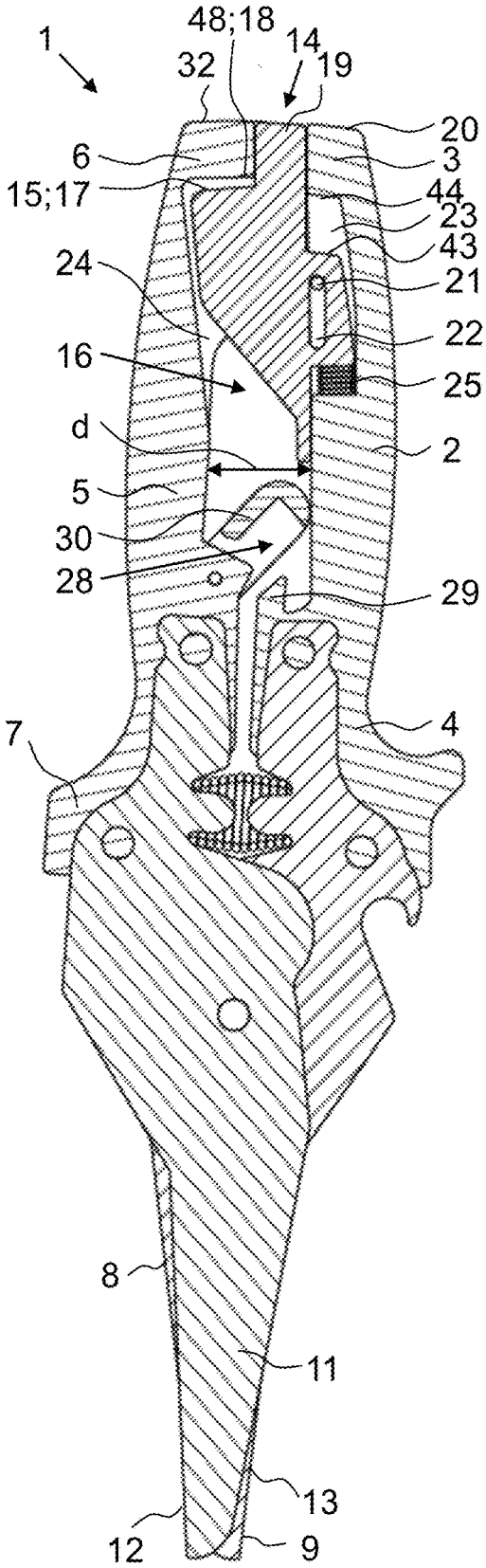
FIG. 8*b* shows a sectional view of the convertible cutting device according to FIG. 8*a;*
Figure 9:
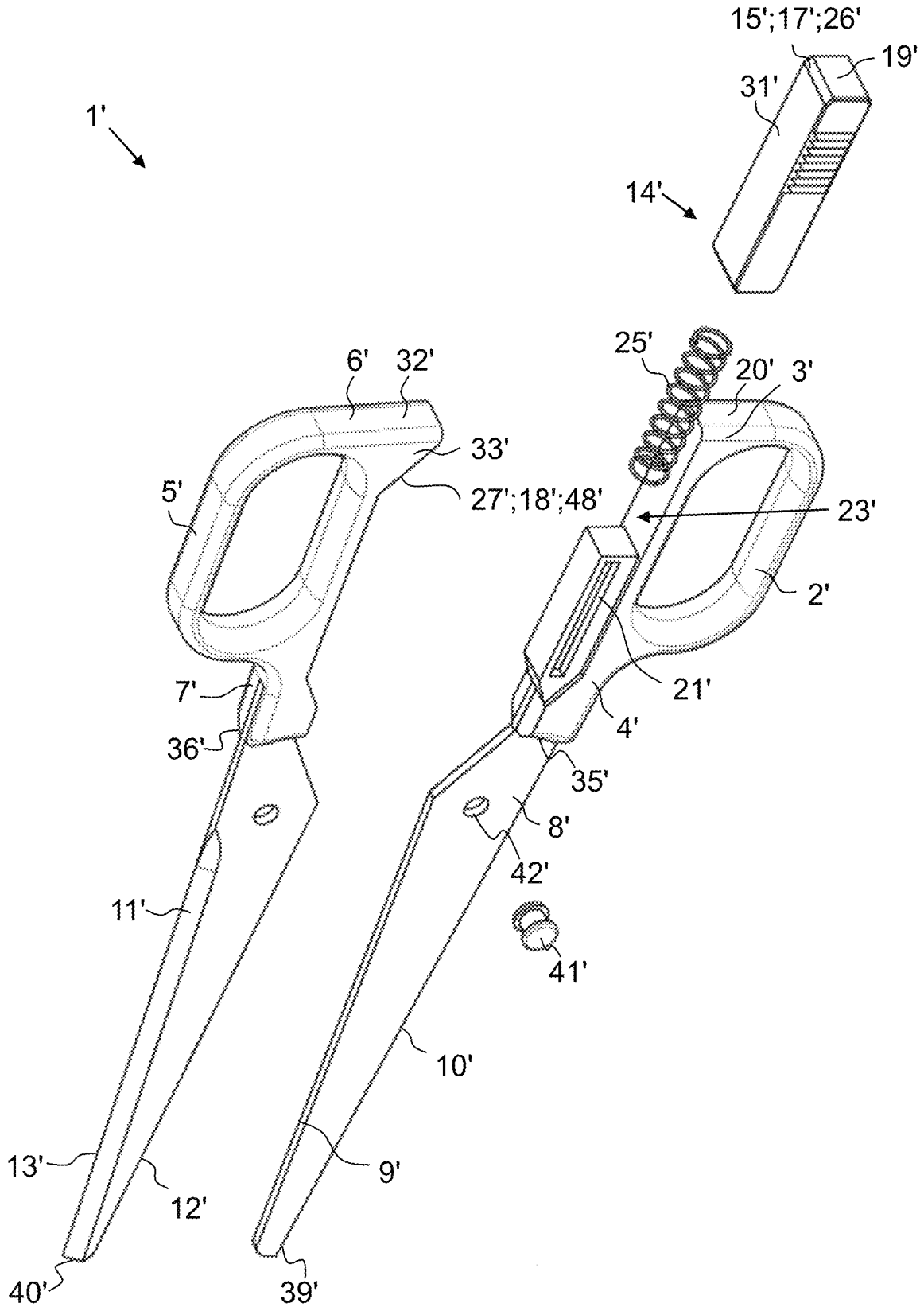
FIG. 9 shows an exploded view of a convertible cutting device comprising a conversion device according to a second embodiment.
Figure 10:
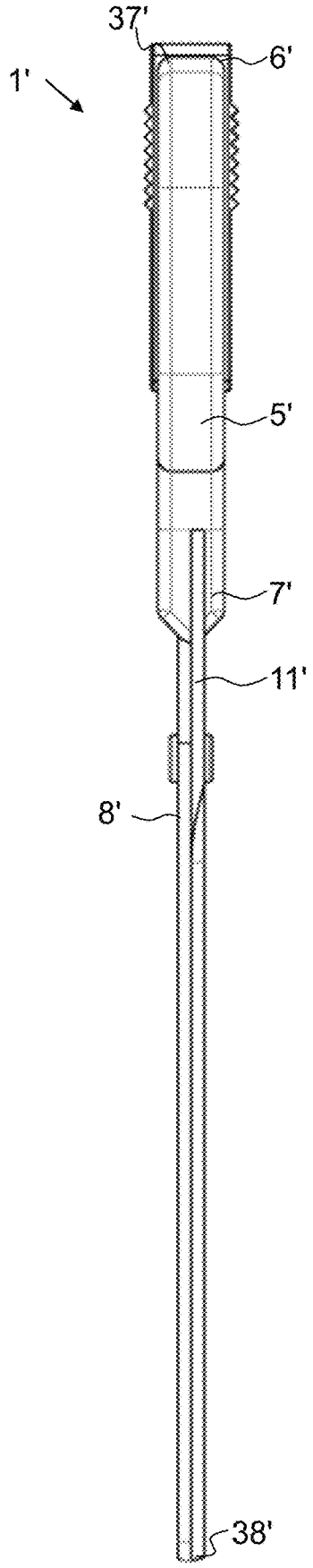
FIG. 10 shows a top view of the convertible cutting device according to FIG. 9.
Figure 11:
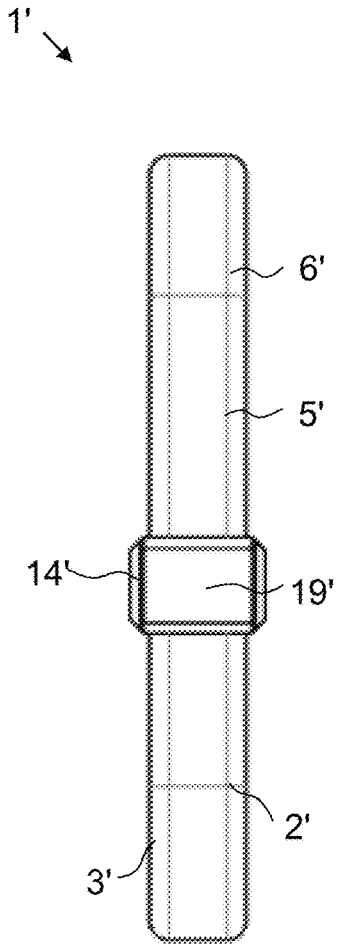
FIG. 11 shows a rear view of the convertible cutting device according to FIG. 9.
Figure 12A:
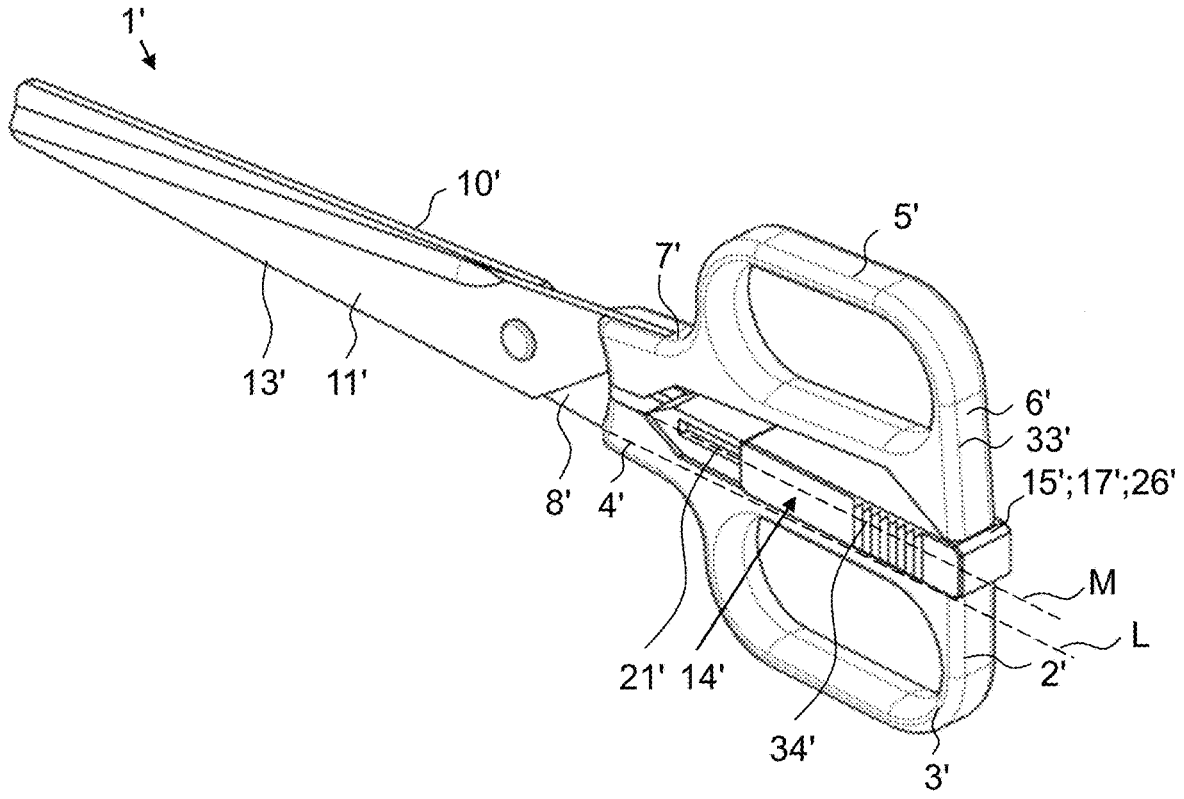
FIG. 12*a* shows a perspective view of the convertible cutting device according to FIG. 9, wherein the handles are in a closed position and the conversion device is in a scissor position.
Figure 12B:
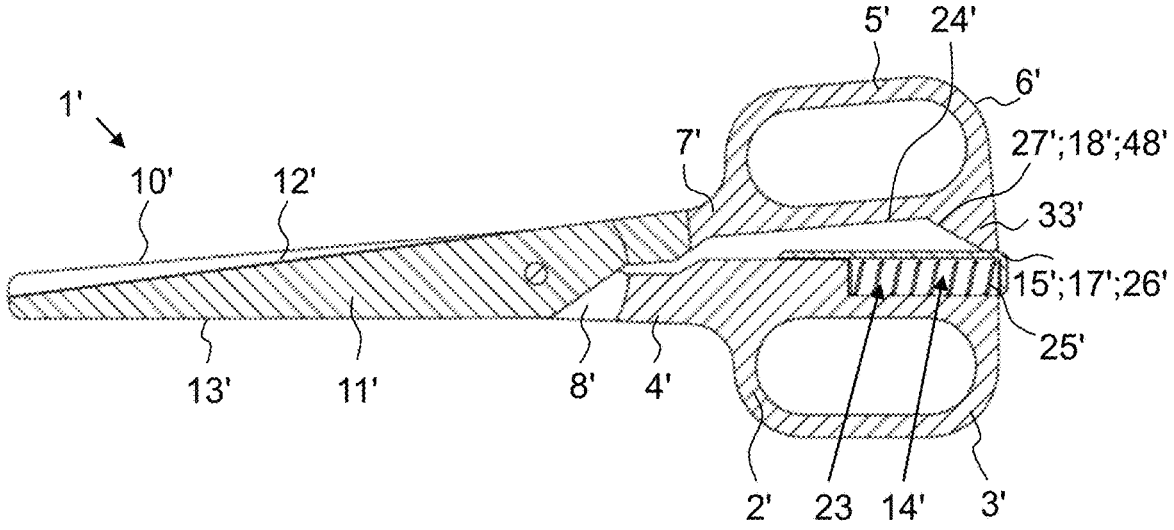
FIG. 12*b* shows a sectional view of the convertible cutting device according to FIG. 12*a;*
Figure 13A:
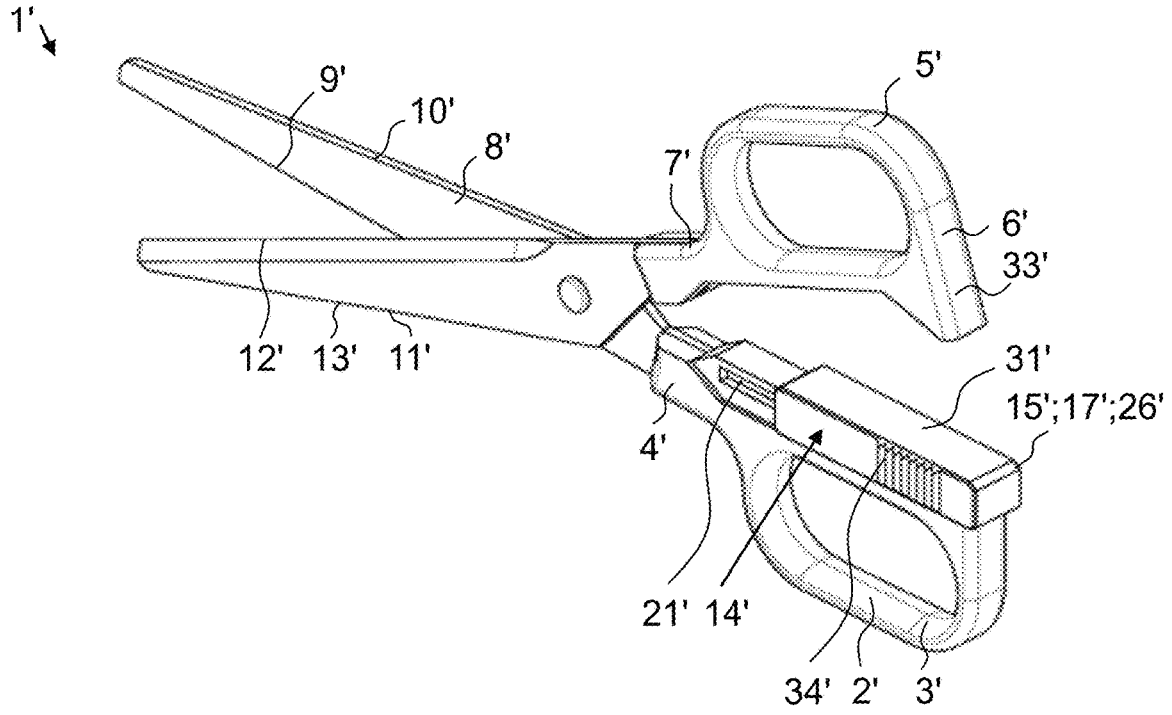
FIG. 13*a* shows a perspective view of the convertible cutting device according to FIG. 9, wherein the handles are in an opened position and the conversion device is in the scissor position.
Figure 13B:
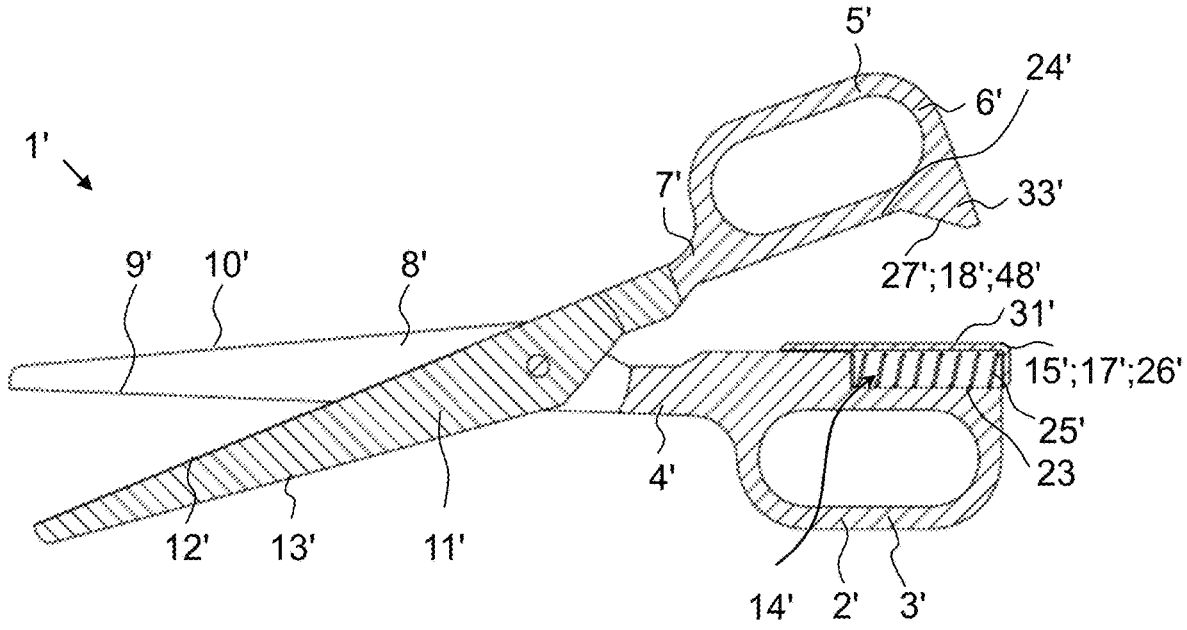
FIG. 13*b* shows a sectional view of the convertible cutting device according to FIG. 13*a;*
Figure 14A:
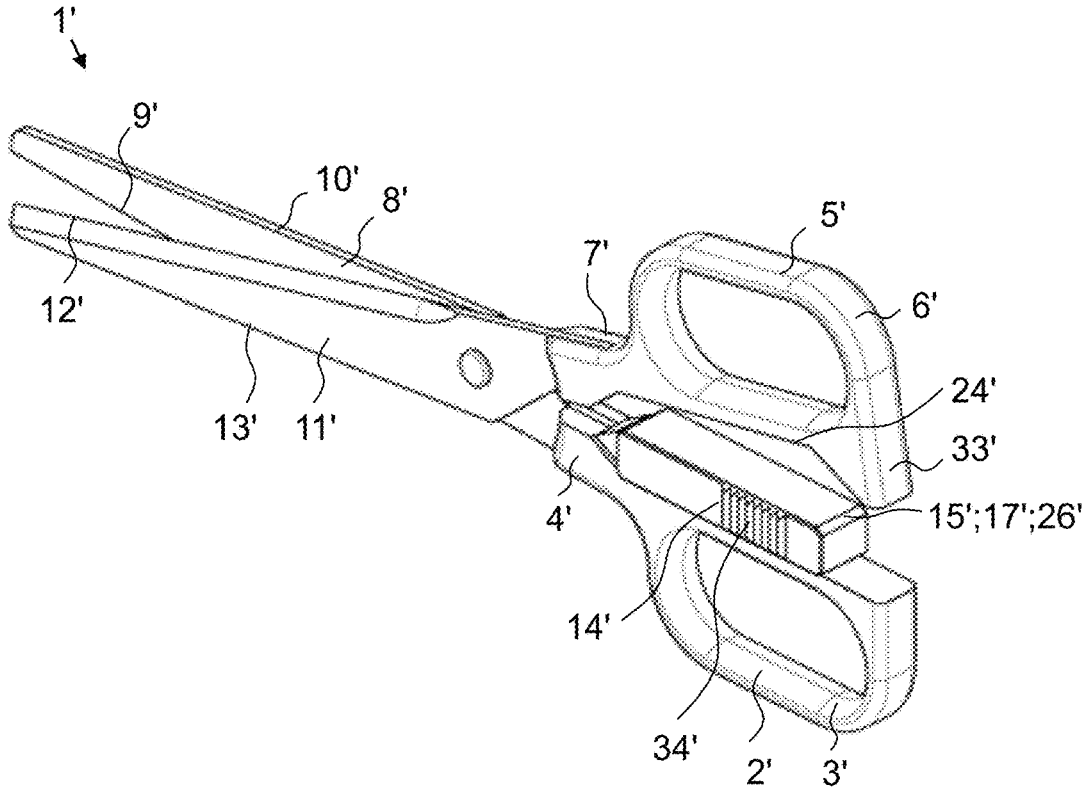
FIG. 14*a* shows a perspective view of the convertible cutting device according to FIG. 9, wherein the handles are in the opened position and the conversion device is in a knife position.
Figure 14B:
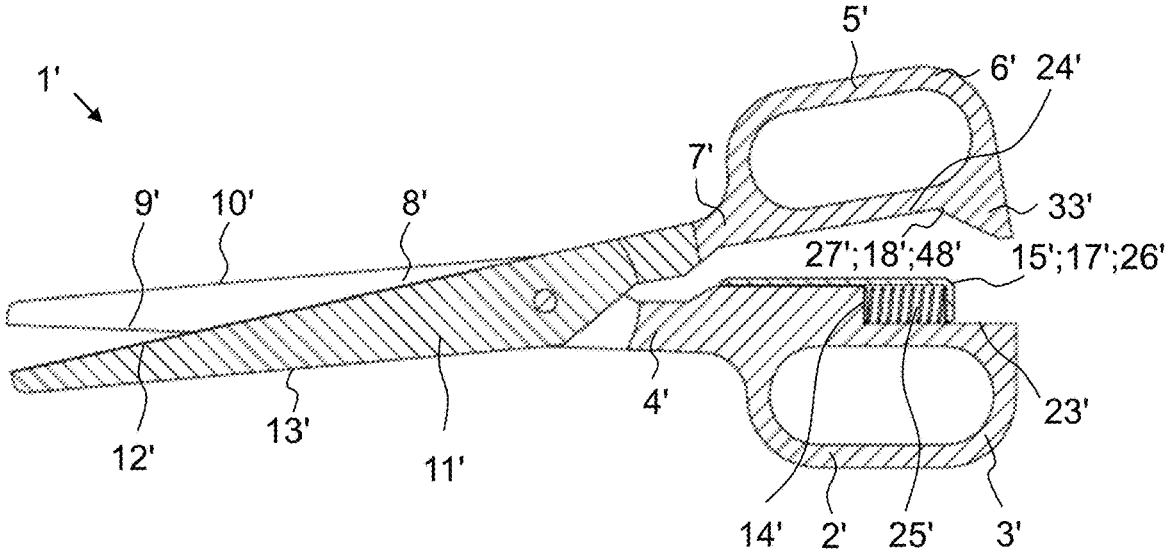
FIG. 14*b* shows a sectional view of the convertible cutting device according to FIG. 14*a;*
Figure 15A:
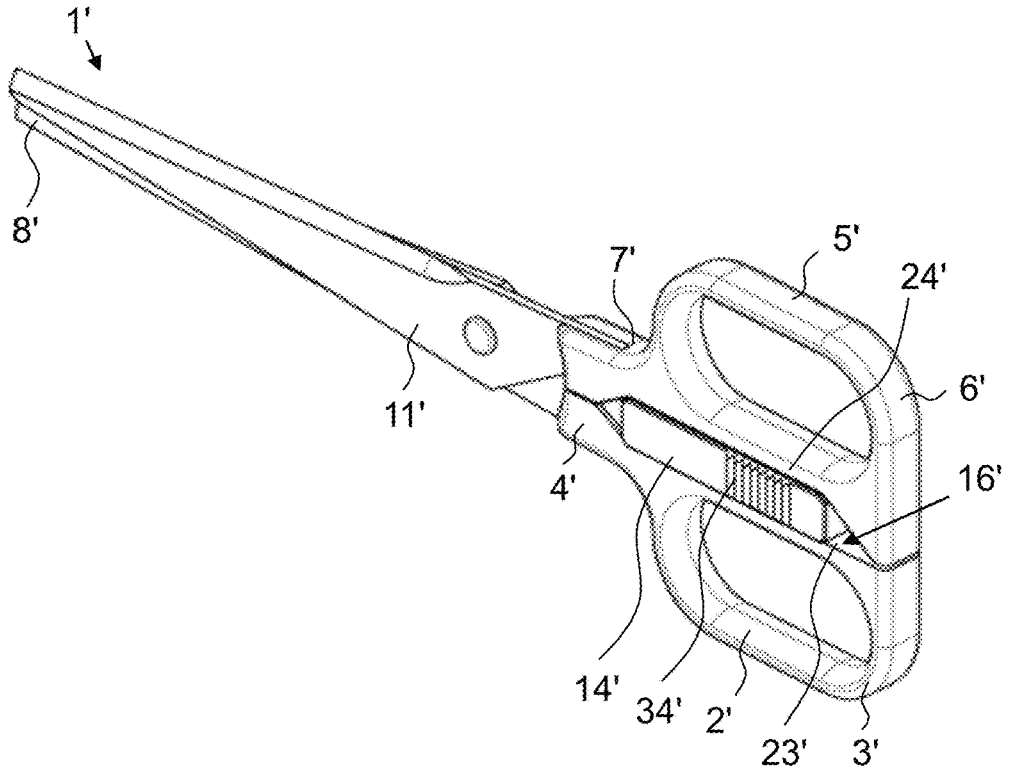
FIG. 15*a* shows a perspective view of the convertible cutting device according to FIG. 9, wherein the handles are in the closed position and the conversion device is in the knife position.
Figure 15B:
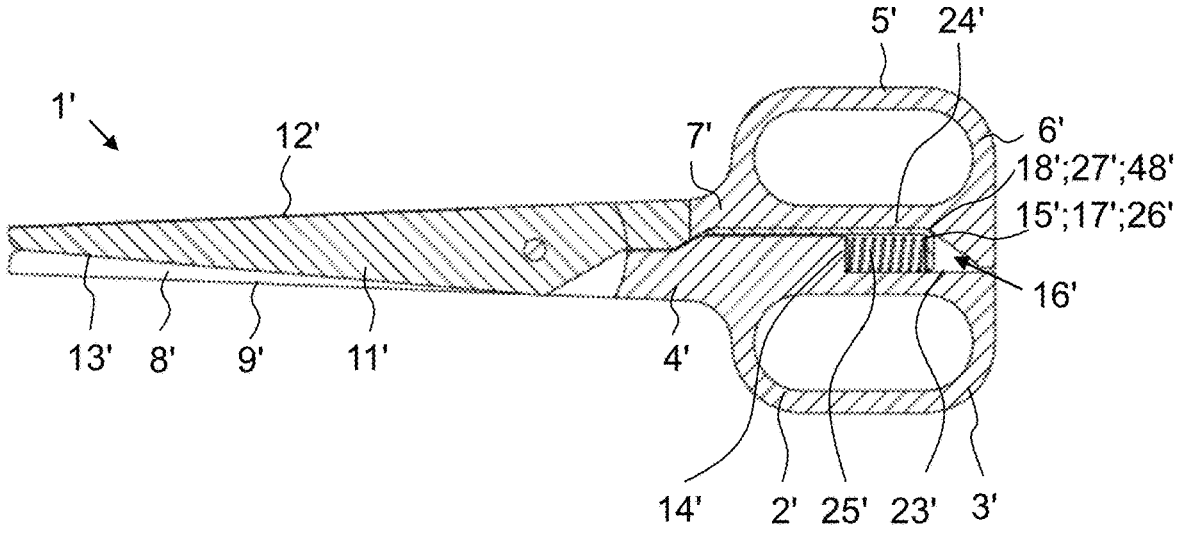
FIG. 15*b* shows a sectional view of the convertible cutting device according to FIG. 15*a*.

As best seen in FIGS. 1 and 9, both embodiments have in common that the convertible cutting device 1, 1' comprises a first handle 2, 2' and a second handle 5, 5' that are pivotably coupled to one another and are pivotable between at least an opened position and a closed position. The first handle 2, 2' comprises a proximal region 3, 3' with a proximal end 20, 20' and a distal region 4, 4' with a distal end 35, 35', wherein a first blade 8, 8' is arranged in the distal region 4, 4' of the first handle 2, 2'. The second handle 5, 5' comprises a proximal region 6, 6' with a proximal end 32, 32' and a distal region 7, 7' with a distal end 36, 36', wherein a second blade 11, 11' is arranged in the distal region 7, 7' of the second handle 5, 5'. The proximal end 20, 20' of the first handle 2, 2' and the proximal end 32, 32' of the second handle 5, 5' provide the proximal end 37, 37' of the convertible cutting device 1, 1'. Likewise, a distal end 39, 39' of the first blade 8, 8' and a distal end 40, 40' of the second blade 11, 11' provide the distal end 38, 38' of the convertible cutting device 1, 1'. The first and second blades 8, 8', 11, 11' are pivotably connected to one another by a hinge rivet 41, 41' that extends through holes 42, 42' being provided in the blades 8, 8', 11, 11'. Thereby, the handles 2, 2', 5, 5' are pivotably connected to one another. The first blade 8, 8' comprises a first cutting edge 9, 9' and a first outer edge 10, 10' being arranged opposite to the first cutting edge 9, 9'. The second blade 11, 11' likewise comprises a second cutting edge 12, 12' and a second outer edge 13, 13' being arranged opposite to the second cutting edge 12, 12'. Whereas the first and second cutting edges 9, 9', 12, 12' are facing one another, the first and second outer edges 10, 10', 13, 13' are facing towards an outside. The convertible cutting device 1, 1' furthermore comprises a conversion device 14, 14', wherein the conversion device 14, 14' is configured to adapt at least a scissor position (see FIGS. 2 to 6*b* and FIGS. 10 to 13*b*) and a knife position (see FIGS. 7*a* to 8*b* and FIGS. 14*a* to 15*b*). When the conversion device 14, 14' is in the scissor position, the conversion device 14, 14' prevents the first cutting edge 9, 9' from extending beyond the second outer edge 13, 13' and furthermore prevents the second cutting edge 12, 12' from extending beyond the first outer edge 10, 10. When the conversion device 14, 14' is in the knife position, the first cutting edge 9, 9' extends at least partially beyond the second outer edge 13, 13' and the second cutting edge 12, 12' extends at least partially beyond the first outer edge 10, 10'. In the depicted examples, the conversion device 14, 14' and the second handle 5, 5' comprise in each case an abutment section 15, 15'; 18, 18', and wherein the abutment section 15, 15' of the conversion device 14, 14' and the abutment section 18, 18' of the second handle 5, 5' are configured to abut against one another when the conversion device 14, 14' is in the knife position and when the first handle 2, 2' and the second handle 5, 5' are in the closed position, whereby the conversion device 14, 14' is retained in the knife position. This situation is depicted in FIGS. 8*a* and 8*b* for the first embodiment and in FIGS. 15*a* and 15*b* for the second embodiment. As can be seen in these figures, the conversion devices 14, 14' of the first embodiment and of the second embodiment are different in shape. In fact, the conversion device 14 of the first embodiment can be said to have the shape of a wedge, whereas the conversion device 14' of the second embodiment has a rectangular shape.

As follows from the figures, in both embodiments the conversion device 14, 14' is arranged in the proximal region 3, 3' of the first handle 2, 2' as well as in the proximal region 6, 6' of the second handle 5, 5'. In other words, the conversion device 14, 14' is arranged in a proximal region of the convertible cutting device 1, 1'. Again in other words, the conversion device 14, 14' is arranged remote from the blades 8, 8', 11, 11'. The conversion device 14, 14' comprises at least one actuation element 19, 19', 34', and wherein the conversion device 14, 14' is transferable from the scissor position into the knife position upon an actuation of the actuation element 19, 19', 34'. In fact, in the first embodiment and as seen in FIGS. 2 to 6*b*, the conversion device 14 comprises a single actuation element 19 protruding from a proximal end 20 of the first handle 2 and from a proximal end 32 of the second handle 5 when the conversion device 14 is in the scissor position. Here, said actuation element 19 has the form of a knob or button that can be pushed along a pushing direction extending from the proximal end 37 of the convertible cutting device 1 towards the distal end of the convertible cutting device 38, whereby the conversion device 14 is pushed along the pushing direction as well. This pushing can be done one-handed, for instance by pushing the proximal end 37 of the convertible cutting device 1 against another object such as a table, a leg of a user, etc. In the second embodiment and as seen in FIGS. 10 to 13*b*, the actuation element 19' protrudes from a proximal end 20' of the first handle 2' and from a proximal end 32' of the second handle 5' when the conversion device 14' is in the scissor position as well. However, and in contrast to the conversion device 14 of the first embodiment, the conversion device 14' of the second embodiment comprises a first actuation element 19' protruding from the proximal ends 20', 32' of the handles 2', 5' when the conversion device 14' is in the scissor position as well as a second actuation element 34' laterally protruding from the handles 2', 5'. The first actuation element 19' here again has the shape of a knob or button, albeit protruding proximally to a lesser extent than the actuation element 19 of the conversion device 14 according to the first embodiment. The second actuation element 34' is a laterally protruding gripping element in the form of a corrugated surface that can be gripped by a user in order to push the actuation element 19' and thus the conversion device 14' along the pushing direction, see e.g. FIGS. 10, 12*a*, 13*a*, 14*a*, and 15*a*. That is, the second actuation element 34' laterally protrudes from the handles 2', 5' in any position of the conversion device 14', i.e. not only in the scissor position but also in the knife position.

As follows from a comparison of FIG. 1 and FIG. 9, for instance, the convertible cutting device 1 according to the first embodiment comprises spring-loaded blades 8, 11 that are spring-loaded by a spring 35 being arranged between the blades 8, 11. In the absence of a pressing force being exerted on the handles 2, 5, the spring 35 biases the handles 2, 5 into the opened position.

In order to prevent the convertible cutting device 1 from adapting the opened position, the convertible cutting device 1 comprises a locking device 28, wherein the locking device 28 is configured to lock the first handle 2 and the second handle 5 in the closed position. As follows from FIG. 1, the locking device 28 comprises a first engagement element 29 in the form of a lug being arranged on the first handle 2 and a second engagement element 30 in the form of a hook being configured to engage the lug 29 and being arranged on the second handle 5. In particular, the second engagement element 30 is pivotably mounted to the second handle 5 by means of a lock pin 46 and is furthermore spring-loaded by means of a lock spring 47. Thereby, the locking device 28 is configured such, that a locking of the first handle 2 and the second handle 5 in the closed position is released upon pressing the first handle 2 and the second handle 5 against one another. In fact, upon pressing the handles 2, 5 together, the engagement between the first engagement element 29 and the second engagement element 30 is removed, see FIGS. 5*a* and 5*b*, whereupon the blades 8, 11 and thus the handles 2, 5 are pushed into the opened position because of the spring 35 biasing the blades 8, 11 into the open position, see FIGS. 6*a* and 6*b*.

Moreover, and as follows from FIGS. 8*a* and 8*b*, as a safety measure the locking device 28 is configured such that a locking of the first handle 2 and the second handle 5 is prevented when the conversion device 14 is in the knife position. This is achieved by providing the second engagement element 30 with a length l being larger than a diameter d of a retaining space 16 being formed between the handles 2, 5 in the region of the locking device 28.

That is, the convertible cutting devices 1, 1' according to the first and second embodiment in each case comprise a retaining space 16, 16' that is formed between the first handle 2, 2' and the second handle 5, 5' when being in the closed position. Moreover, and as best seen in FIGS. 8*a* and 8*b* for the first embodiment and in FIGS. 15*a* and 15*b* for the second embodiment, the conversion device 14, 14' is at least partially (first embodiment) or entirely (second embodiment) arranged within said retaining space 16, 16' when the conversion device 14, 14' is in the knife position.

As mentioned initially, the conversion device 14, 14' is retained in the knife position because of abutting abutment sections 15, 15', 18, 18 provided on the conversion device 14, 14' and the second handle 5, 5'. As follows from these figures, the abutment sections 15, 15', 18, 18' correspond in the depicted examples to abutment surfaces 17, 17' being provided on the conversion device 14, 14' and to abutment surfaces 48, 48' being provided on the second handle, wherein the abutment surfaces 48, 48' of the second handle partially delimit the retaining space.

Figure 4A:
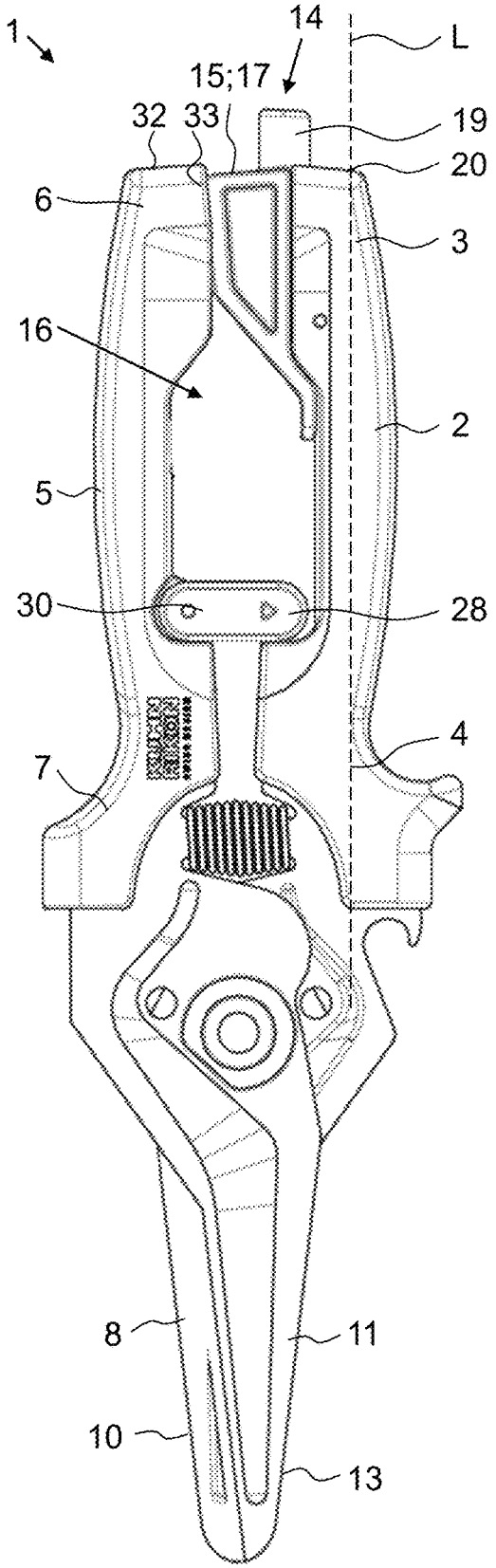
FIG. 4*a* shows a side view of the convertible cutting device according to FIG. 1, wherein the handles are in a closed position and in a locked position and the conversion device is in a scissor position.
Figure 4B:
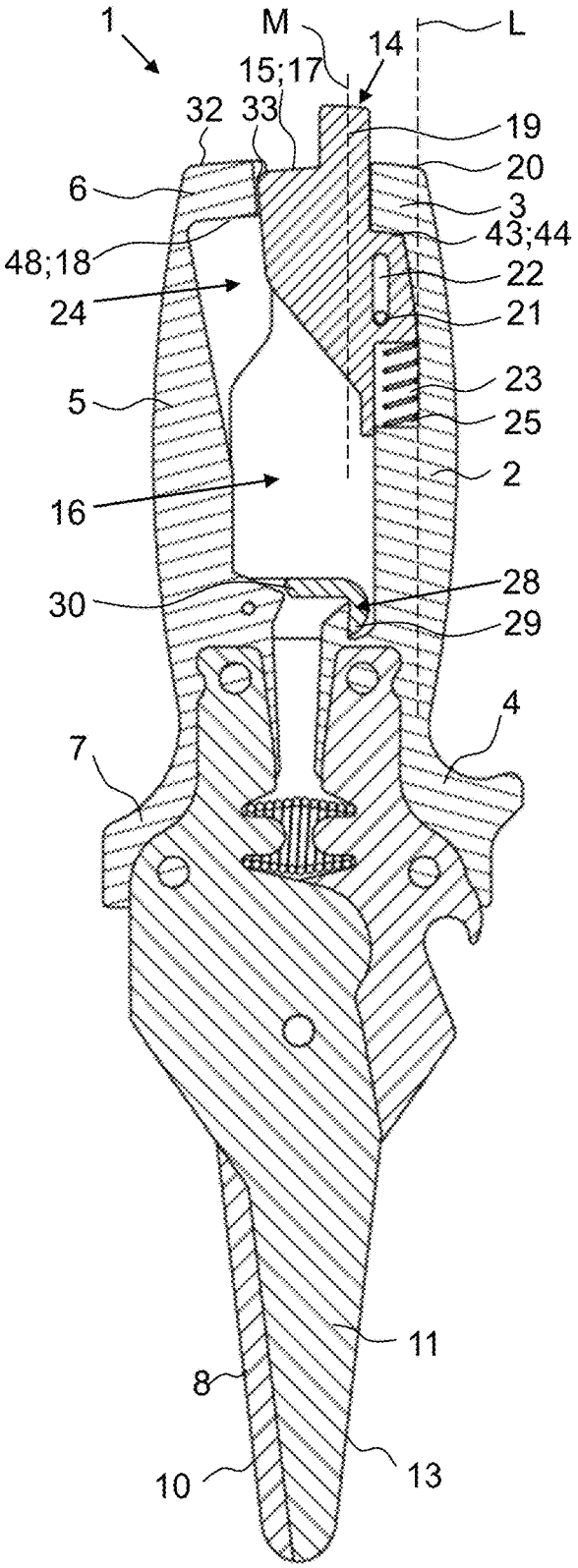
FIG. 4*b* shows a sectional view of the convertible cutting device according to FIG. 4*a;*
Figure 5A:
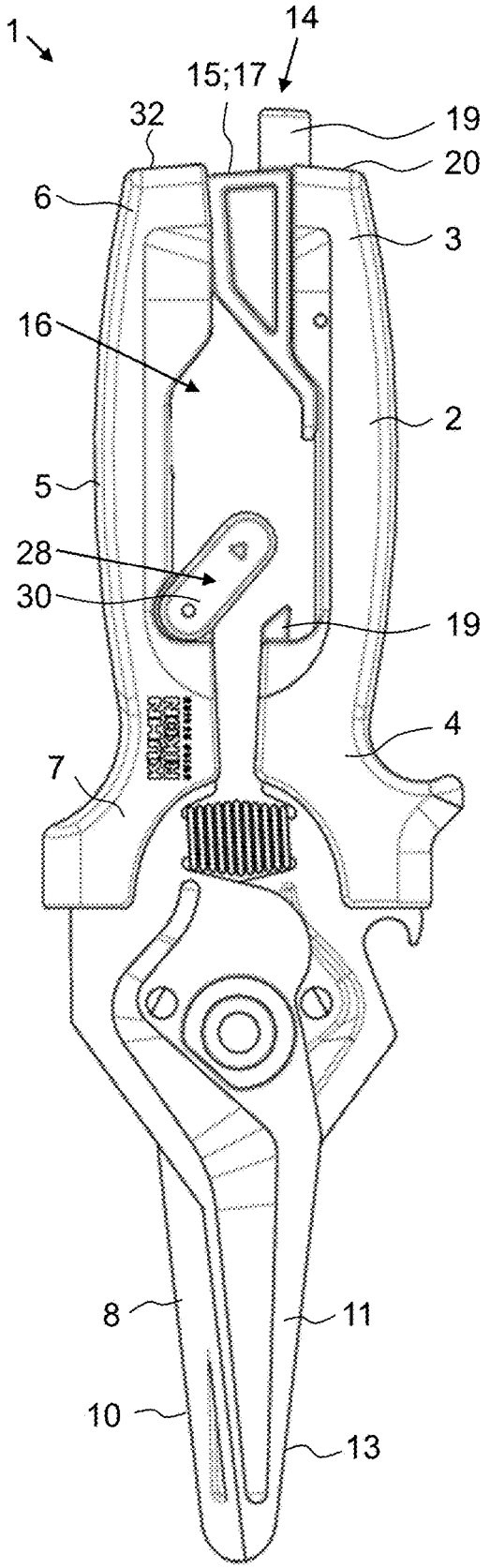
FIG. 5*a* shows a side view of the convertible cutting device according to FIG. 1, wherein the handles are in a closed position and in an unlocked position and the conversion device is in the scissor position.
Figure 5B:
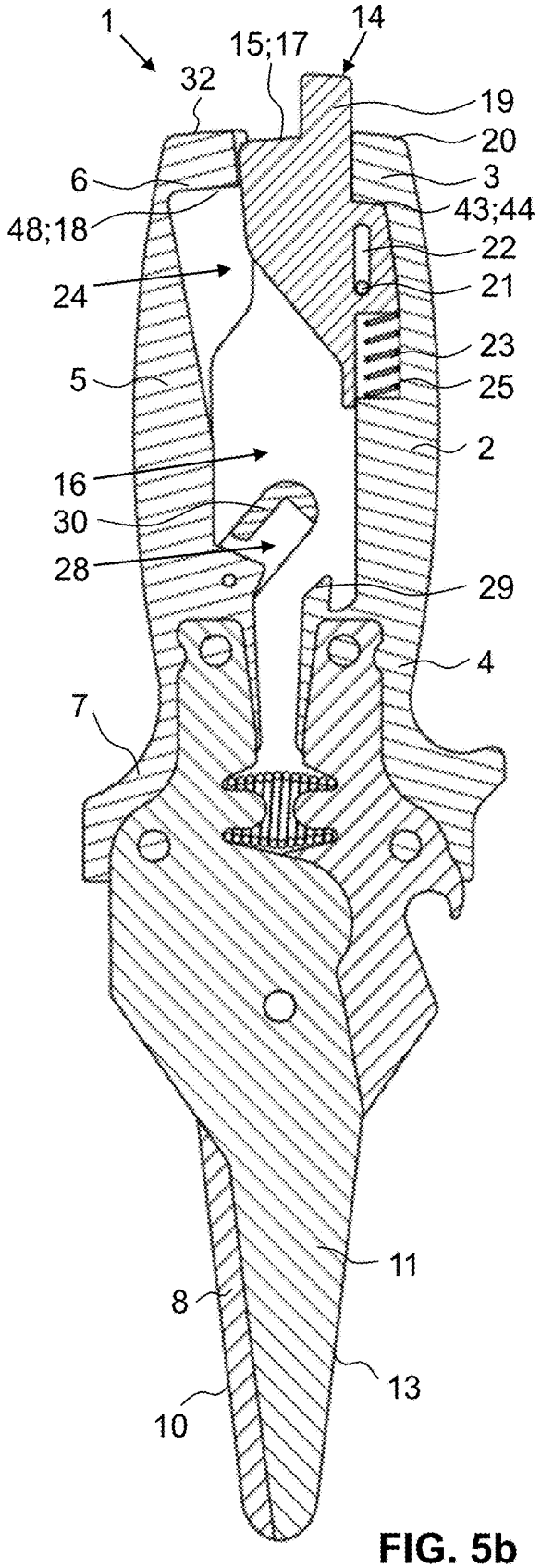
FIG. 5*b* shows a sectional view of the convertible cutting device according to FIG. 5*a;*
Figure 6A:
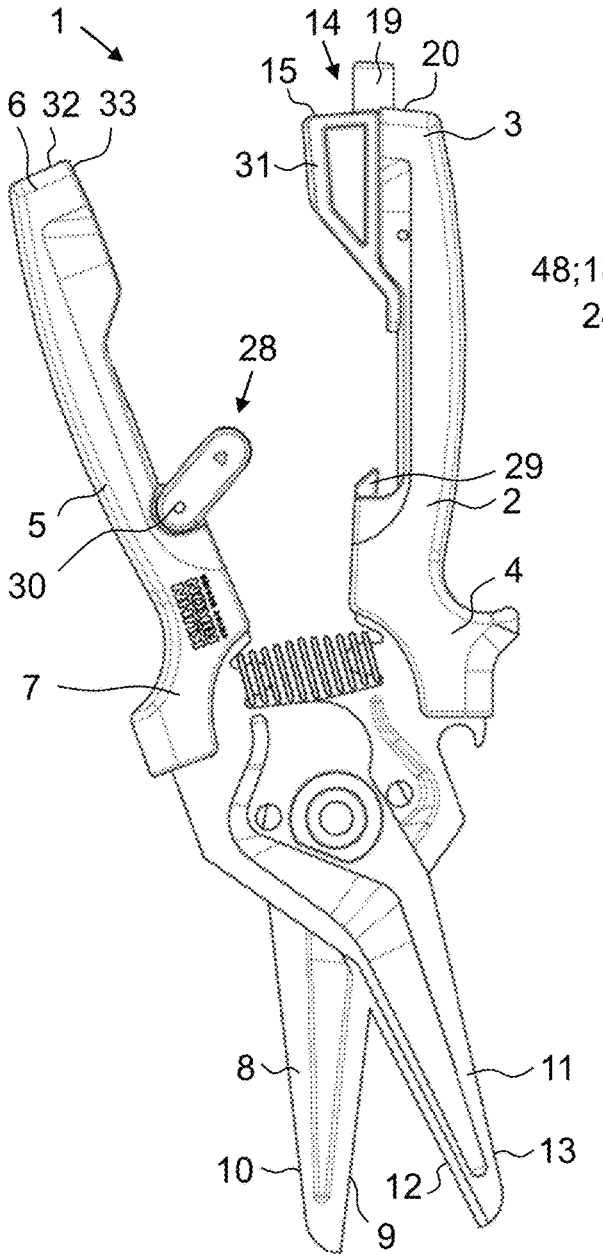
FIG. 6*a* shows a side view of the convertible cutting device according to FIG. 1, wherein the handles are in an opened position and the conversion device is in the scissor position.
Figure 6B:
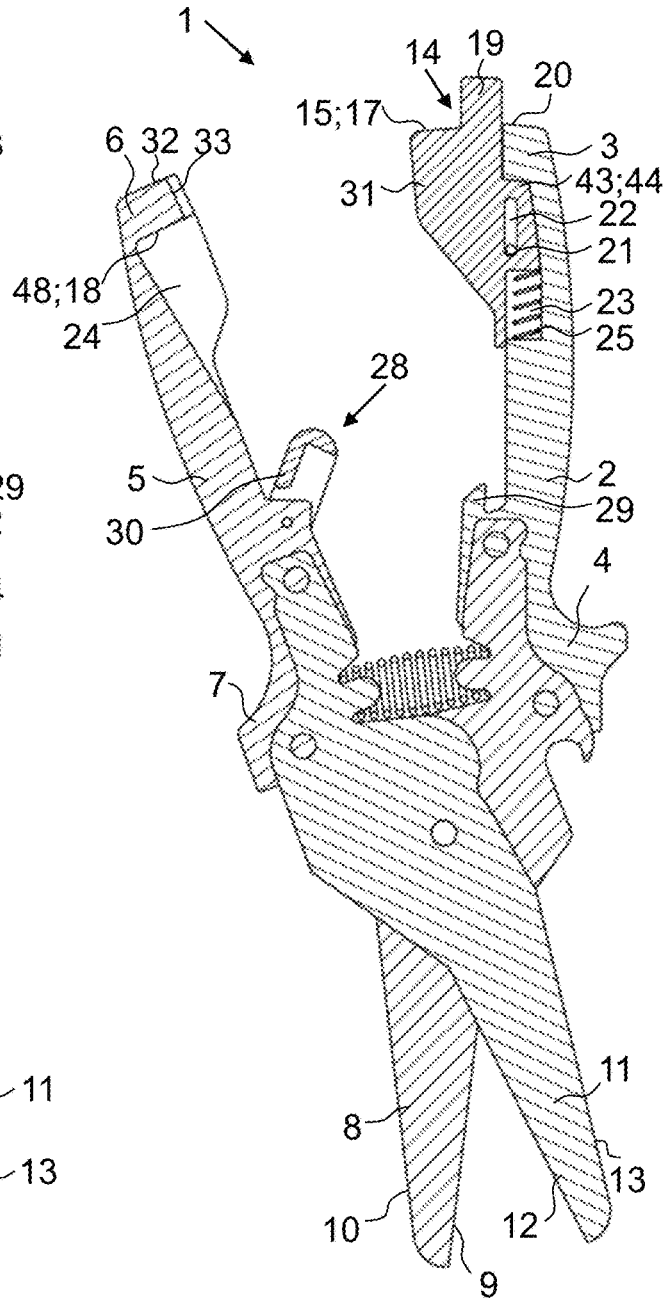
FIG. 6*b* shows a sectional view of the convertible cutting device according to FIG. 6*a;*
Figure 7A:
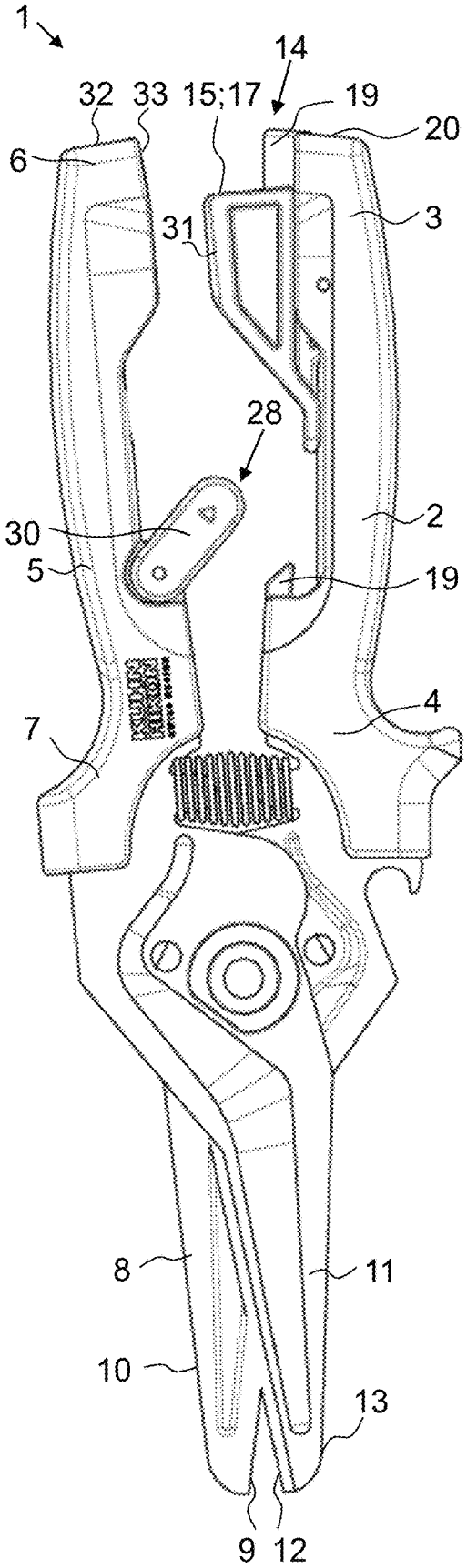
FIG. 7*a* shows a side view of the convertible cutting device according to FIG. 1, wherein the handles are in the opened position and the conversion device is in a knife position.
Figure 7B:
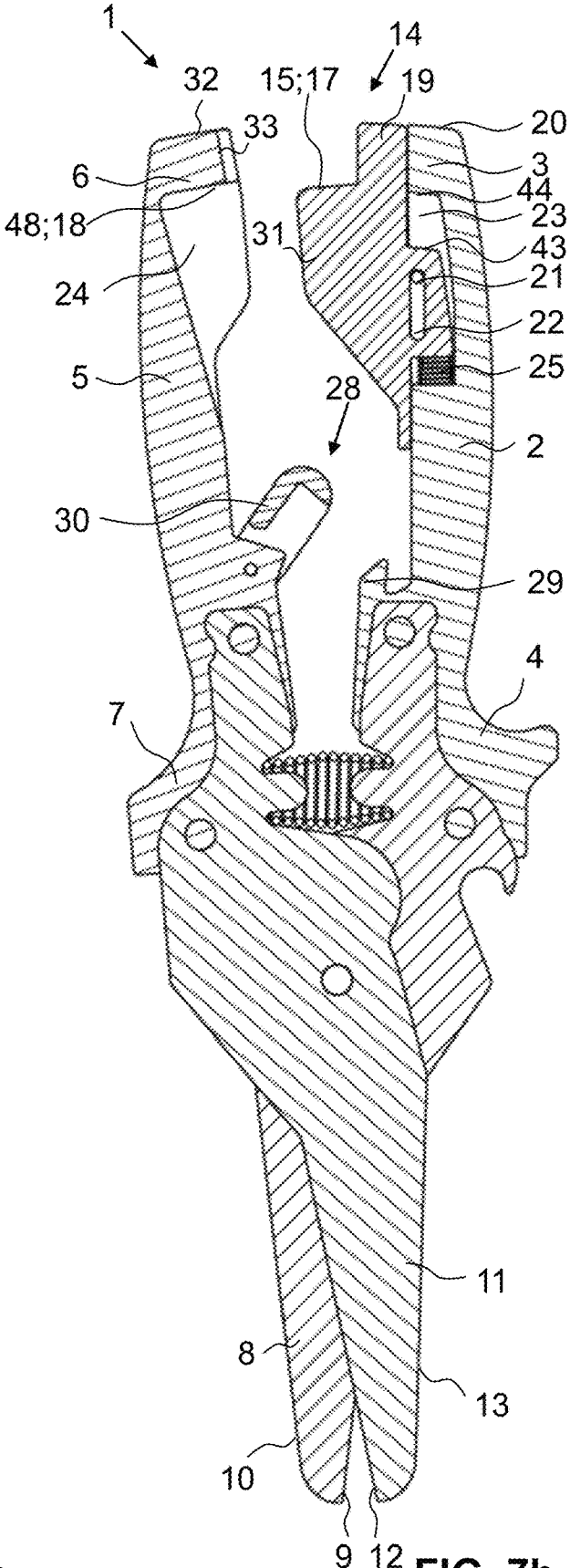
FIG. 7*b* shows a sectional view of the convertible cutting device according to FIG. 7*a;*

The retaining space 16, 16' is furthermore partly delimited by a recess 23, 23' being formed in the first handle 2, 2' as well as by a recess 24, 24' being formed in the second handle 5, 5'. The recess 23, 23' of the first handle 2, 2' is arranged on an inner side of the first handle 2, 2' and the recess 24, 24' of the second handle 5, 5' is arranged on an inner side of the second handle 5, 5', wherein the inner sides of the handles 2, 2', 5, 5' face one another. In both embodiments, the abutment section 18, 18' of the second handle 5, 5' in the form of the abutment surface 48, 48' partially delimits the recess of the second handle. In the first embodiment, the recess 16 is partially delimited by a holding section 44 of the first handle 2 in the form of a surface. As seen in FIGS. 4*b*, 5*b* and 6*b*, said holding section 44 abuts against a holding section 43 in the form of a surface being provided on the conversion device 14 when the conversion device 14 is in the scissor position.

As follows from FIGS. 4*a* to 8*b* and from FIGS. 12*a* to 15*b*, the conversion device 14, 14' is movable along as well as at least partially within the recesses 23, 23' of the first and second handles 2, 2', 5, 5'. That is, the conversion device 14, 14' is movably mounted on the first handle 2, 2' and is movable along the first and second handles 2, 2', 5' when being transferred from the scissor position into the knife position and when being transferred from the knife position into the scissor position, respectively. To this end the conversion device 14, 14' performs a linear movement extending along an axis M being parallel to a longitudinal axis L of the first handle 2, 2'.

Said movement of the conversion device 14, 14' occurs in a guided manner by means of a guiding element 21, 21' being arranged on the first handle 2, 2' and a corresponding guiding element 22, 22' being arranged on the conversion device 14, 14'. In the first embodiment, the guiding element 21 of the first handle 2 corresponds to a guiding pin that engages a guiding element 22 of the conversion device 14 in the form of a guiding slot, see FIGS. 1, 4*b*, 5*b*, 6*b*, 7*b* and 8*b*. Here, the guiding slot 22 of the conversion device 14 is arranged within the recess 23 of the first handle 2, where it is engaged by the guiding pin 21 extending through and being mounted in holes 49 arranged in sidewalls of the first handle 2. In the second embodiment, the guiding element 21' of the first handle 2' corresponds to a guiding slot being provided in the first handle 2' and being engagable by a guiding pin (not depicted) being provided on the conversion device 14'.

The convertible cutting device 1, 1' according to both embodiments comprises a biasing element 25, 25' that biases the conversion device 14, 14' into the scissor position. In the depicted examples, the biasing element 25, 25' corresponds to a spring that is arranged on the first handle 2, 2' and in particular in the recess 23, 23' of the first handle 2, 2'. Furthermore, in the first embodiment, the conversion device 14 is transferred from the knife position into the scissor position in the absence of a pressing of the first handle 2, 2' and the second handle 5, 5' against one another because of the spring-loaded blades 8, 11 that are biasing the handles 2, 5 into the opened position, whereby the abutment between the abutment sections 15, 18 of the second handle 5 and the conversion device 14 is removed.

In the second embodiment, the absence of a pressing force being exerted on the handles 2', 5' results in the handles 2, 5' and thus the blades 8', 11' being pivoted away from one another as well. Namely, the conversion device 14' of the second embodiment comprises a pushing element 26' and that the second handle 5' comprises a pushable element 27', and wherein the pushing element 26' pushes against the pushable element 27' in the absence of a pressing force being exerted onto the first handle 2' and the second handle 5', whereby the second handle 5' is pivotable away from the first handle 2'. This pushing is caused by the biasing force of the biasing element 25' that biases the conversion device 14' into the scissor position, since the conversion device 14' and thus its pushing element 26' pushes against the pushable element 27' of the second handle 5' while the conversion device 14' transfers from the knife position into the scissor position. When the handles 2', 5' are pivoted away from one another, the abutment being established between the abutment section 18' of the second handle 5' and the abutment section 15' of the conversion device 14' is removed.

As follows from FIGS. 14*a* to 15*b*, the pushing element 26' of the conversion device 14' corresponds here to a surface of the conversion device 14' that abuts and thereby pushes against the pushable element 27' of the second handle 5' in the form of a surface as well when the conversion device 14' transfers from the knife position into the scissor position and in the event that the handles 2', 5' are not pressed towards one another. That is, the pushing element 26' and the conversion device 14' are a single-piece element and the pushable element 27' and the second handle 5' are a single-piece element, respectively. Furthermore, the pushable element 27' of the second handle 5' is inclined, in fact an inclined surface, that increasingly runs towards the first handle 2' or downwards with respect to a direction running from the distal end 38' of the convertible cutting device 1' towards the proximal end 37' of the convertible cutting device 1'.

Also the pushing element 26' of the conversion device 14' is inclined, namely an inclined surface, that increasingly runs towards the first handle 2' or downwards with respect to the direction running from the distal end 38' of the convertible cutting device 1' towards the proximal end 37' of the convertible cutting device 1'. The inclination of the pushing element 26' and the inclination of the pushable element 27' are in this case the same and run parallel to one another. In fact, an angle of inclination by which the pushable element 27' is inclined and an angle of inclination by which the pushing element 26' is inclined are the same. With increasing displacement of the conversion device 14' in the direction of the proximal end 37' of the convertible cutting device 1', the pushing element 26' of the conversion device 14' is therefore pressed against the pushable element 27' and moved along its inclined surface, whereby the second handle 5' is increasingly pivoted away from the first handle 2'.

Furthermore, the pushable element 27' of the second handle 5' at least partially delimits the retaining space 16' when the handles 2', 5' are in the closed position. Moreover, the abutment section 18' of the second handle 5' comprises the pushable element 27'. In fact, a part of the pushable element 27' in the form of the inclined surface forms the abutment section 18' of the second handle 5' in the form of the abutment surface 48'. Similarly, the abutment section 15' of the conversion device 14' comprises the pushing element 26'. In fact, the pushing element 26' in the form of the said surface forms part or here even provides the abutment section 15' of the conversion device 14' in the form of the abutment surface 17'.

In order to limit a pivoting of the first handle 2, 2' with respect to the second handle 5, 5' the second handle 5, 5' comprises a limiting element 33, 33' and the conversion device 14, 14' comprises a limiting element 31, 31'. The limiting elements 31, 31', 33, 33' define a minimal spacing between the first handle 2, 2' and the second handle 5, 5' when the first handle 2, 2' and the second handle 5, 5' are in the closed position and when the conversion device 14, 14' is in the scissor position. In fact, said minimal spacing results in the first and second blades 8, 8'; 11, 11' being arranged to perform the scissor operation and furthermore ensure that the blades remain in that position. This limitation or minimal spacing is provided by an abutment between the limiting elements 31, 31', 33, 33'. In fact, and as seen in FIGS. 4*a* to 5*b* and FIGS. 12*a* 12*b*, the limiting elements 31, 31', 33, 33' abut against one another when the handles 2, 2', 5, 5' are in the closed position and the conversion device 14, 14' is in the scissor position. In the first embodiment and the second embodiment, the limiting element 33, 33' of the second handle 5, 5' corresponds to a protruding element that protrudes inwards, i.e. towards the first handle 2, 2', and which terminates in a free end defining an abutment surface, i.e. the limiting surface. In both embodiments, the limiting element 31, 31' of the conversion device 14, 14' likewise defines an abutment surface, i.e. a limiting surface. However, whereas in the first embodiment the limiting element 31 of the conversion device 14 corresponds to a protruding element protruding inwards, i.e. towards the second handle 5, the limiting element 31' of the conversion device 14' of the second embodiment is provided by a flat or even surface of the conversion device 14'. Thus, in the first embodiment the minimal spacing is defined by a height of the protrusion of the limiting element 33 of the second handle 5 and a height of the protrusion of the limiting element 31 of the conversion device 14. In the second embodiment, said minimal spacing is defined by the height of the protrusion of the limiting element 33' of the second handle 5' only. The transfer of the conversion device 14, 14' from the scissor position into the knife position removes the limitation imposed by the limiting elements 31, 31', 33, 33', whereby the first blade 8, 8' and the second blade 11, 11' can be pivoted past one another, see FIGS. 7*a* to 8*b* and 14*a* to 15*b*.

The invention claimed is:

1. A convertible cutting device comprising:

a first handle comprising a proximal region and a distal region;

a second handle comprising a proximal region and a distal region;

a first blade being arranged in the distal region of the first handle and comprising a first cutting edge and a first outer edge being arranged opposite to the first cutting edge;

a second blade being arranged in the distal region of the second handle and comprising a second cutting edge and a second outer edge being arranged opposite to the second cutting edge; and a conversion device;

wherein the first handle and the second handle are pivotably coupled to one another and are pivotable between at least an opened position and a closed position, wherein the conversion device is configured to adapt at least a scissor position and a knife position, wherein, when the conversion device is in the scissor position, the conversion device prevents the first cutting edge from extending beyond the second outer edge and furthermore prevents the second cutting edge from extending beyond the first outer edge, and wherein, when the conversion device is in the knife position, at least one of the first cutting edge extends at least partially beyond the second outer edge and the second cutting edge extends at least partially beyond the first outer edge, wherein the conversion device and the second handle comprise in each case at least one abutment section, and wherein the abutment section of the conversion device and the abutment section of the second handle are configured to abut against one another when the conversion device is in the knife position and when the first handle and the second handle are in the closed position, whereby the conversion device is retained in the knife position.

2. The convertible cutting device according to claim 1, wherein the first handle and the second handle when being in the closed position define a retaining space, and wherein the conversion device is at least partially arranged within said retaining space when the conversion device is in the knife position.

3. The convertible cutting device according to claim 1, wherein the conversion device is arranged at least one of in the proximal region of the first handle and in the proximal region of the second handle.

4. The convertible cutting device according to claim 1, wherein the conversion device comprises at least one actuation element, and wherein the conversion device is transferable from the scissor position into the knife position upon an actuation of the actuation element.

5. The convertible cutting device according to claim 4, wherein at least one of i) the actuation element at least partially protrudes from at least one of a proximal end of the first handle and a proximal end of the second handle when the conversion device is in the scissor position, ii) the actuation element and the conversion device are a single-piece element, and iii) the actuation element laterally protrudes from at least one of the first handle and the second handle.

6. The convertible cutting device according to claim 1, wherein the conversion device is movably mounted on the first handle and is configured to move along the first handle at least one of when being transferred from the scissor position into the knife position and when being transferred from the knife position into the scissor position.

7. The convertible cutting device according to claim 6, wherein the conversion device performs at least one of a linear movement and a movement extending along an axis being parallel to a longitudinal axis of the first handle.

8. The convertible cutting device according to claim 1, wherein the first handle and the conversion device in each case comprise at least one guiding element, and wherein the guiding elements are configured to guide a movement of the conversion device.

9. The convertible cutting device according to claim 1, wherein at least one of i) the conversion device is transferable from the scissor position into the knife position when the first handle and the second handle are in the opened position, and ii) the conversion device is transferable from the knife position into the scissor position in the absence of a pressing of the first handle and the second handle against one another.

10. The convertible cutting device according to claim 1, wherein at least one of i) the first handle comprises a recess and wherein the conversion device is movable at least one of along and at least partially within said recess, and ii) the second handle comprises at least one recess, and wherein the conversion device is movable at least one of along and at least partially within said recess.

11. The convertible cutting device according to claim 10, wherein the recess of the second handle is at least partially delimited by the abutment section of the second handle.

12. The convertible cutting device according to claim 1, further comprising a biasing element that biases the conversion device into the scissor position.

13. The convertible cutting device according to claim 12, wherein at least one of the biasing element is arranged on the first handle, the biasing element is arranged in the recess of the first handle, and the biasing element is a spring.

14. The convertible cutting device according to claim 1, wherein at least one of i) the second handle comprises a limiting element being configured to limit a pivoting of the first handle with respect to the second handle and ii) the conversion device comprises a limiting element being configured to limit a pivoting of the first handle with respect to the second handle.

15. The convertible cutting device according to claim 1, wherein at least one of i) the conversion device is configured such, that the first handle and the second handle are pivoted towards one another while the conversion device is transferred from the scissor position into the knife position and ii) the conversion device is configured such, that the first handle and the second handle are pivoted away from one another while the conversion device is transferred from the knife position into the scissor position.

16. The convertible cutting device according to claim 1, further comprising at least one locking device, wherein at least one of i) the locking device is configured to lock the first handle and the second handle in the closed position, ii) the locking device is configured such that a locking of the first handle and the second handle is prevented when the conversion device is in the knife position, iii) the locking device is configured such, that a locking of the first handle and the second handle in the closed position is released upon pressing the first handle and the second handle against one another.

17. The convertible cutting device according to claim 16, wherein the locking device is at least one of spring-loaded and comprises at least a first engagement element and a second engagement element that are configured to engage one another, whereby the locking device is in a locking position where it locks the first handle and the second handle in the closed position.

18. The convertible cutting device according to claim 17, wherein at least one of i) the first engagement element is provided on the first handle and the second engagement element is provided on the second handle, and ii) a length of the second engagement element is larger than a diameter of the retaining space.

19. The convertible cutting device according to claim 1, wherein the conversion device comprises at least one pushing element and the second handle comprises at least one pushable element, and wherein the pushing element is configured to push against the pushable element in the absence of a pressing force being exerted onto the first handle and the second handle whereby the second handle is pivotable away from the first handle.

* * * * *